US008608029B2

(12) United States Patent
Lee

(10) Patent No.: US 8,608,029 B2
(45) Date of Patent: Dec. 17, 2013

(54) COSMETIC CONTAINER FOR MIXING AND USING HETEROGENEOUS CONTENTS

(75) Inventor: Kang-Min Lee, Incheon (KR)

(73) Assignee: Yonwoo Co., Ltd., Incheon (KR)

( * ) Notice: Subject to any disclaimer, the term of this patent is extended or adjusted under 35 U.S.C. 154(b) by 81 days.

(21) Appl. No.: 13/255,496

(22) PCT Filed: Feb. 18, 2010

(86) PCT No.: PCT/KR2010/001011

§ 371 (c)(1),
(2), (4) Date: Sep. 8, 2011

(87) PCT Pub. No.: WO2010/104272

PCT Pub. Date: Sep. 16, 2010

(65) Prior Publication Data

US 2011/0315574 A1 Dec. 29, 2011

(30) Foreign Application Priority Data

Mar. 10, 2009 (KR) ..... 10-2009-0020496

(51) Int. Cl.
*B67D 7/70* (2010.01)

(52) U.S. Cl.
USPC ..... 222/135; 222/145.6; 222/144.5; 222/137; 222/405

(58) Field of Classification Search
USPC ..... 222/135, 137, 145.5, 144.5, 405, 145.6, 222/131; 206/219, 568
See application file for complete search history.

(56) References Cited

U.S. PATENT DOCUMENTS

| | | | | | |
|---|---|---|---|---|---|
| 4,826,048 | A * | 5/1989 | Skorka et al. | ..... | 222/137 |
| 5,224,627 | A * | 7/1993 | Weag | ..... | 222/135 |
| 5,823,394 | A * | 10/1998 | Davis et al. | ..... | 222/137 |
| 6,082,588 | A * | 7/2000 | Markey et al. | ..... | 222/137 |
| 6,402,364 | B1 * | 6/2002 | Esclar et al. | ..... | 366/160.4 |
| 6,817,753 | B2 * | 11/2004 | Buenger et al. | ..... | 366/336 |
| 7,124,914 | B2 * | 10/2006 | Foster et al. | ..... | 222/137 |
| 7,137,531 | B2 * | 11/2006 | Arghyris et al. | ..... | 222/94 |
| 7,481,334 | B2 * | 1/2009 | Arghyris et al. | ..... | 222/137 |
| 8,225,962 | B2 * | 7/2012 | Rossignol | ..... | 222/137 |
| 2003/0146242 | A1 * | 8/2003 | Peterson | ..... | 222/137 |
| 2005/0042122 | A1 * | 2/2005 | Arghyris et al. | ..... | 417/521 |
| 2008/0110930 | A1 * | 5/2008 | Wittkamp et al. | ..... | 222/135 |

FOREIGN PATENT DOCUMENTS

| | | | | | |
|---|---|---|---|---|---|
| JP | 3097937 | U | 3/2003 | | |
| JP | 2004-51122 | A | 2/2004 | | |
| KR | 2004/0440663 | * | 6/2008 | ..... | A45D 40/24 |
| KR | 200440663 | | 6/2008 | | |
| KR | 2020080002044 | | 6/2008 | | |

OTHER PUBLICATIONS

KR200440663 Jung-Hyeon Gi Jun. 24, 2008 English Machine Translation.*

* cited by examiner

*Primary Examiner* — Frederick C Nicolas
*Assistant Examiner* — Bob Zadeh

(57) ABSTRACT

A cosmetic container for mixing and using heterogeneous contents, which makes it possible to discharge proper amounts of heterogeneous cosmetics from a pair of discharge ports and simply mix the same, includes an elliptical mixing part which has an inwardly inclined surface at an upper side of a cosmetic container.

2 Claims, 4 Drawing Sheets

COSMETIC CONTAINER FOR MIXING AND USING HETEROGENEOUS CONTENTS

TECHNICAL FIELD

The present invention relates to a cosmetic container for mixing and using heterogeneous contents, and in particular to a cosmetic container for mixing and using heterogeneous contents which makes it possible to discharge proper amounts of cosmetics from a pair of discharge ports and simply mixing the same by forming an elliptical mixing part which has an inwardly inclined surface at an upper side of a cosmetic container.

BACKGROUND ART

A cosmetic container generally comprises a body for storing contents therein, and a discharge part which is engaged to an upper side of the body and discharges the cosmetic stored in the body, to the outside. In recent years, life quality is significantly improved, people become more interested in a skin care and beauty, so diverse cosmetics are under development to provide better beauty effects to people, and various kinds of cosmetic containers are at present under development to meet people's demands.

When a user is intended to use cosmetics by mixing heterogeneous cosmetics such as an essence, a moisturizing cream, etc. by proper amounts, a user is needed to discharge each cosmetic on his hands or in a container and then to mix the same, in this case the procedures of which are very complicated.

DISCLOSURE OF INVENTION

Accordingly, the present invention is directed to overcoming the problems encountered in the conventional art. It is an object of the present invention to provide a cosmetic container for storing and mixing heterogeneous contents which makes it possible to discharge proper amounts of heterogeneous cosmetics from a pair of discharge ports and simply mixing the same by forming an elliptical mixing part which has an inwardly inclined surface at an upper side of a cosmetic container.

To achieve the above objects, there is provided a cosmetic container for mixing and use heterogeneous contents which comprises a mixing container which includes an elliptical mixing part inwardly formed at one side and a pair of cosmetic parts which vertically pass through the upper side of the inclined surface of the mixing part, with a button engaging hole being vertically formed at the other side of the mixing container; a pair of buttons which are installed at the button engaging hole and have springs installed at their lower sides, respectively; an outer container which is installed at a lower side of the mixing container; storing containers which include a pair of housings which are installed in the interior of the outer container and store cosmetics therein and have pistons at their lower sides; fixtures which are inserted into the upper sides of the housings and have insertion holes formed at the central portions of the same; piston rods the central potions of which pass through vertically with the diameters larger than the diameters of the insertion holes and are connected with the cosmetic discharge parts, with the lower side of the piston rods being inserted into the insertion holes; recovery springs which are installed between the fixtures and the upper sides of the piston rods; and dispensers which are inserted into the lower sides of the piston rods and have check valves formed at their lower sides and opened or closed by the pressure of the cosmetics; and a lower container which is installed at a lower side of the outer container for thereby closing the lower side of the outer container.

At the upper sides of the cosmetic discharge parts are formed a rubber tip which is engaged to the upper sides of the discharge parts and guides the cosmetics, which are discharged from the cosmetic discharge parts, to flow along an inclined surface of the mixing part.

There is further provided a fixing panel which is installed at an upper side of the outer container and has a fixing part extended from an upper side to a lower side and is engaged to the outer surfaces of the storing containers, respectively.

ADVANTAGEOUS EFFECTS

The present invention advantageously makes it possible to discharge proper amounts of heterogeneous cosmetics from a pair of discharge ports and simply mixing the same by forming an elliptical mixing part which has an inwardly inclined surface at an upper side of a cosmetic container.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

Figure 1:
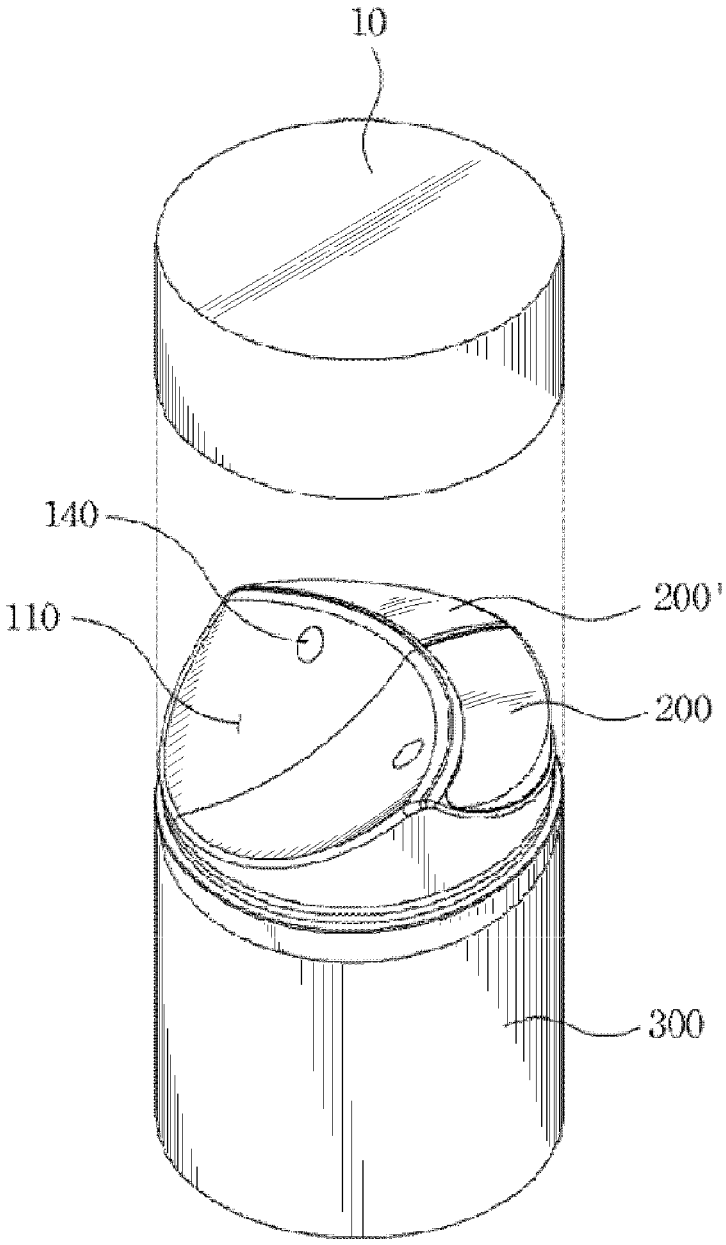
FIG. 1 is a perspective view illustrating a cosmetic container for mixing and using heterogeneous contents according to a preferred embodiment of the present invention.

The preferred embodiments of the present invention will be described with reference to the accompanying drawings. The reference numerals in each drawing mean the same elements.

Figure 2:
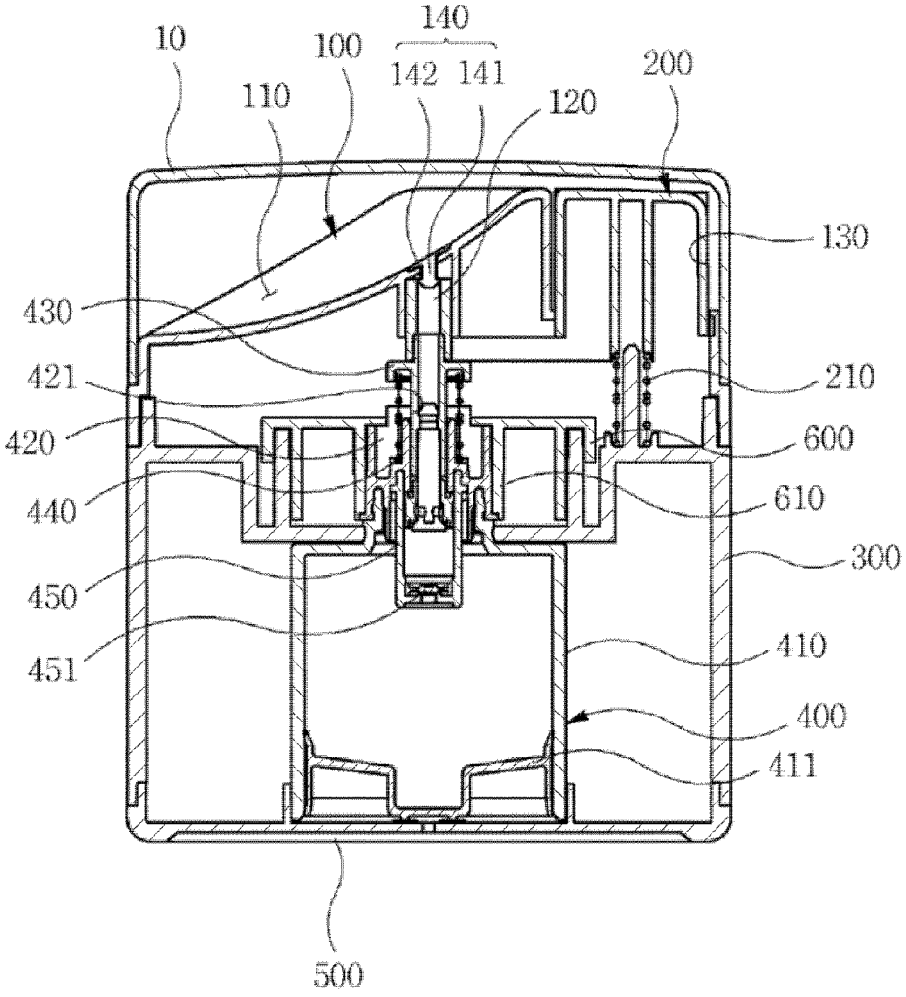
FIG. 2 is a lateral cross sectional view illustrating a cosmetic container for mixing and using heterogeneous contents according to a preferred embodiment of the present invention.
Figure 3:
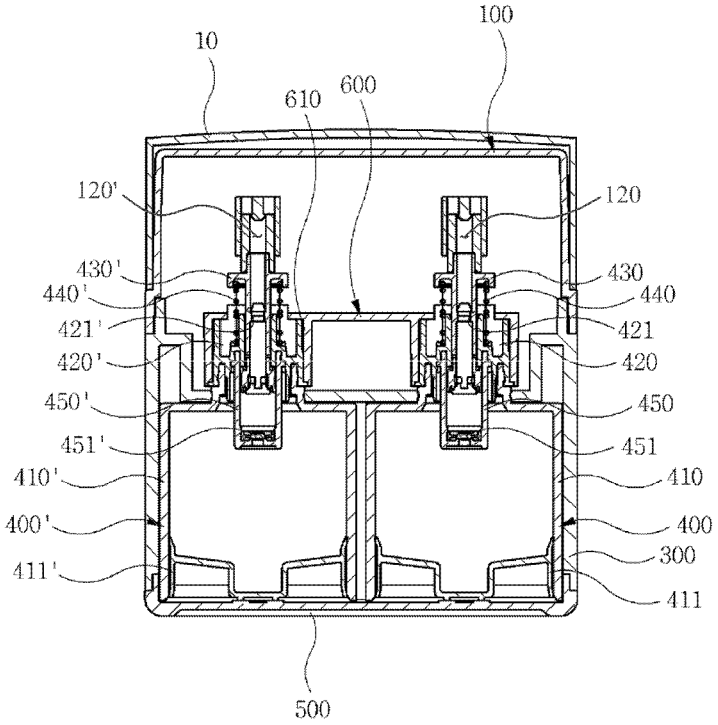
FIG. 3 is a front cross sectional view illustrating a cosmetic container for mixing and using heterogeneous contents according to a preferred embodiment of the present invention.

FIG. 1 is a perspective view illustrating a cosmetic container for mixing and using heterogeneous contents according to a preferred embodiment of the present invention, and FIG. 2 is a lateral cross sectional view illustrating a cosmetic container for mixing and using heterogeneous contents according to a preferred embodiment of the present invention, and FIG. 3 is a front cross sectional view illustrating a cosmetic container for mixing and using heterogeneous contents according to a preferred embodiment of the present invention.

As shown in FIGS. 1 to 3, the cosmetic container for mixing and using heterogeneous contents according to a preferred embodiment of the present invention comprises a mixing container 100, a button 200, 200', an outer container 300, a storing container 400, and a lower container 500. There are further provided a rubber tip 140 and a fixing panel 600.

The mixing container 100 comprises a mixing part 110 with an inward elliptical inclined surface at its one side, and a button engaging hole 130 which is formed at the side and passes through the same in a vertical direction. A user discharges heterogeneous cosmetics and mix the same in the mixing part 110. Here, the mixing part 110 is not limited to its disclosed construction. Any construction making it possible to prevent the contents from flowing outward of the mixing part 110 is acceptable. As shown in FIG. 2, the mixing part 110 is preferably formed in an elliptical shape by which a user can easily mix heterogeneous cosmetics with the tips of fingers. When not in use, the cap 10 is engaged to an upper side of the mixing container 100.

Figure 4:
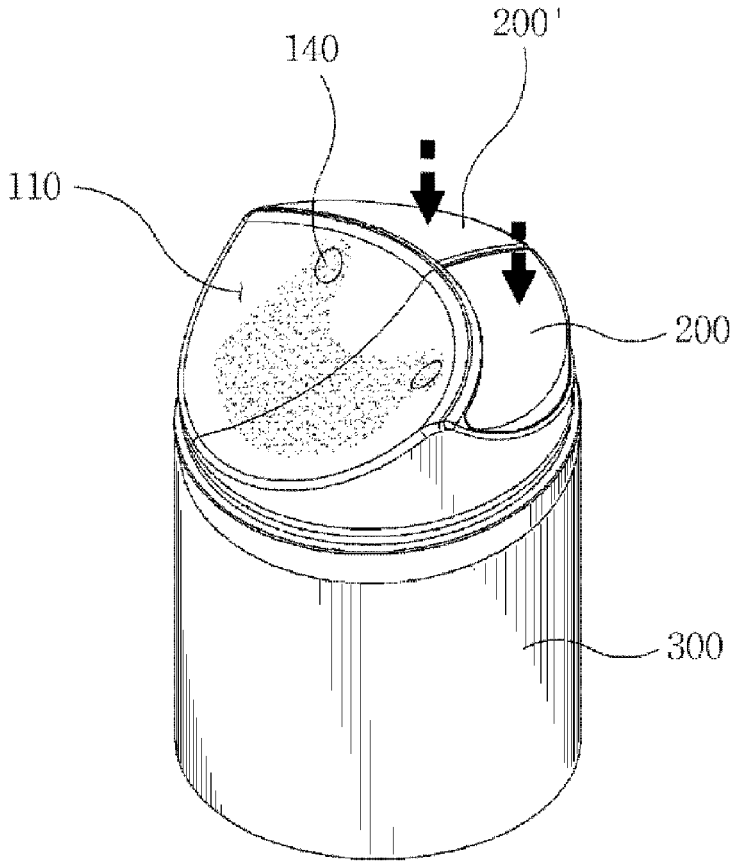
FIG. 4 is a view of a use state of a cosmetic container for mixing and using heterogeneous contents according to a preferred embodiment of the present invention.

A pair of cosmetic discharge parts 120 and 120' pass through the upper side of the inclined surface of the mixing part 110 in a vertical direction. When the buttons 200 and 200', which will be described later, are pushed, the cosmetics are discharged via the cosmetic discharge parts 120 and 120'. As shown in FIG. 4, the discharged cosmetics are discharged to the upper side of the mixing part 110. As a key subject matter of the present invention, a user is directed to discharging heterogeneous cosmetics and mixing the discharged heterogeneous cosmetics in the mixing part 110.

The button engaging hole 130 passes through one side of the mixing container 100 in a vertical direction. The buttons 200 and 200' are engaged to the button engaging holes 130, respectively, so the cosmetics are discharged to the outside depending on the pressurizing operation of the buttons 200 and 200'.

The rubber tip 140 is tightly inserted into the upper ends of the cosmetic discharge parts 120 and 120', thus guiding the cosmetics from the cosmetic discharge parts 120 and 120' to flow along the inclined surface of the mixing part 110. It is preferred that the rubber tip 140 is made from a smooth material. The rubber tip 140 is formed of an engaging part 141 and a cover part 142.

The engaging part 141 is inserted into the cosmetic discharge parts 120 and 120', and the diameter of the engaging part 141 is smaller than the diameter of the cosmetic discharge part 120, 120'. It is preferred that the cosmetic is discharged along an edge of the cosmetic discharge part 120, 120'.

A cover part 142 is formed at an upper side of the rubber tip 140. The cosmetics discharged from the cosmetic discharge part 120, 120' is guided to flow along the inclined surface of the mixing part 110. The cover part 142 is larger than the diameter of the cosmetic discharge part 120, 120', so the cosmetics are guided to flow along the inclined surface of the mixing part 110 when the cosmetic is discharged.

A pair of buttons 200 and 200' are installed at the button engaging hole 130, respectively. The user pressurizes the buttons 200 and 200', thus discharging cosmetics. Springs 210 are installed at the buttons 200 and 200'. Even when the user pushes the buttons 200 and 200', the buttons 200 and 200' are recovered to their initial positions with the aid of elastic recovery forces of the springs.

The outer container 300 is installed at a lower side of the mixing container 100 and serves to accommodate the storing containers 400 and 400' therein, which will be described later. The upper side of the outer container 10 comes into contact with the lower side of the springs 210, thus helping the buttons 200 and 200' to recover to the upper side with the aids of the springs 210.

The fixing panel 600 is installed at the outer container 300, thus fixing the storing containers 400 and 400' at the inner side of the outer container 300. It is preferred that the diameter of the fixing panel 600 is smaller than the diameter of the outer container 300 and does protrude from the outer side of the outer container 300. The fixing part 610 is downwardly protruded from the lower side of the fixing panel 600 and is engaged with an outer surface of the outer container 300. It is characterized that the fixing panel 600 reliably fixes the storing containers 400 and 400' in the interior of the outer container 300.

A pair of storing containers 400 and 400' are installed in the interior of the outer container 300 for thereby storing cosmetics therein. When the user pressurizes downwardly the buttons 200 and 200', the cosmetics are discharged. Since the storing containers 400 and 400' are detachable from the outer container 300, when the cosmetics run out, they can be exchanged with new one. The storing containers 400 and 400' comprise housings 410 and 410' fixtures 420 and 420', piston rods 430 and 430', recovery springs 440 and 440', and dispensers 450 and 450'.

The housings 410 and 410 serve to store cosmetics therein. The storing containers 400 and 400' store therein diverse cosmetics such as eye cream, moisturizing cream, etc. It is preferred that the storing containers 400 and 400' are made from a synthetic resin material of plastics. The pistons 411 and 411' are installed at the lower sides of the storing containers 400 and 400'. Since the pistons 411 and 411' are compressed by as much as the used cosmetics the volume of which decreases as the user uses, so the pistons 411 and 411' rise upward. The cosmetics remain at the highest heights all the time until all the cosmetics run out. The pistons 411 and 411' are made of smooth materials and serve to seal the places from external air, in which places the cosmetics are stored in the housings 410 and 410'. It is preferred that the portions where the cosmetics are stored remain in vacuum state all the time.

The fixtures 420 and 420' are inserted into the upper sides of the housings 410 and 410', and insertion holes 421 and 421' pass through the central portions of the fixtures 420 and 420' in vertical directions. The fixtures 420 and 420' server to seal the cosmetics in the interiors of the housings 410 and 410'. The piston rods 430 and 430', which will be descried later, are inserted into the insertion holes 421 and 421', respectively.

The piston rods 430 and 430' are inserted into the insertion holes 421 and 421', and the diameters of the central portions of the piston rods 430 and 430' are same as the diameters of the insertion holes 421 and 421', thus preventing the discharge of the cosmetics stored in the interiors of the housings 410 and 410'. The diameters of the upper sides of the piston rods 430 and 430' are bigger than the diameters of the insertion holes 421 and 421', so it is prevented that the piston rods 430 and 430' are escaped into the interiors of the housings 410 and 410' after they have passed through the insertion holes 421 and 421'.

The recovery springs 440 and 440' are installed between the fixtures 440 and 440' and the fixtures 420 and 420'. The recovery springs 440 and 440' server the fixtures 420 and 420' to recover by means of the elastic recovery force of the springs after the fixtures 420 and 420' are pressed upward by means of the buttons 430 and 430'.

The dispensers 450 and 450' are inserted into the lower sides of the piston rods 430 and 430' and have the diameters bigger than the diameters of the insertion holes 421 and 421'. Here, the dispensers 450 and 450' serve to prevent the piston rods 430 and 430' from escaping via the upper sides of the insertion holes 421 and 421'. The check valves 451 and 451' are installed at the lower sides of the dispensers 450 and 450'. When pressure is applied to the check valves 451 and 451', respectively, the cosmetics are introduced into the interiors of the dispensers 450 and 450'. The thusly introduced cosmetics are discharged to the mixing part 110 via the cosmetic discharge parts 120 and 120' through the central portions of the piton rods 430 and 430'.

The lower container 500 is installed at the lower side of the outer container 300 for thereby closing the lower side of the outer container 300. It is preferred that the fixtures corresponding to the outer diameters of the storing containers 400 and 400' are protruded from the upper side of the lower container 500 for allowing the storing containers 400 and 400' to well mount.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A cosmetic container for mixing and using heterogeneous contents, comprising:

a mixing container which includes a mixing part having an inwardly inclined surface at one side to allow a user to mix heterogeneous cosmetics with the tips of fingers and a pair of cosmetic discharge parts which vertically pass through an upper side of the inclined surface of the mixing part, with a button engaging hole being vertically formed at another side of the mixing container;

a pair of buttons which are installed at the button engaging hole, wherein springs are installed at lower sides of the pair of buttons, respectively;

an outer container which is installed at a lower side of the mixing container;

storing containers which include:

a pair of housings which are installed in an interior of the outer container and store the cosmetics therein, wherein pistons are provided at lower sides of the pair of housings;

fixtures which are inserted into upper sides of the housings, wherein insertion holes are formed at central portions of the fixtures;

piston rods of which the central portions pass vertically through, the central portions having diameters larger than diameters of the insertion holes and being connected to the cosmetic discharge parts, with lower sides of the piston rods being inserted into the insertion holes;

recovery springs which are installed between the fixtures and upper sides of the piston rods; and dispensers which are inserted into the lower sides of the piston rods, wherein check valves are formed at lower sides of the dispensers and are opened or closed by the pressure of the cosmetics; and a lower container which is installed at a lower side of the outer container for thereby closing the lower side of the outer container, wherein at upper sides of the cosmetic discharge parts are formed of a rubber tip which is engaged to the upper sides of the discharge parts and guides the cosmetics, which are discharged from the cosmetic discharge parts, to flow along the inclined surface of the mixing part.

2. The cosmetic container of claim 1, further comprising:

a fixing panel which is installed at an upper side of the outer container and has a fixing part extended from an upper side to a lower side and engaged to outer surfaces of the storing containers, respectively.

* * * * *